US007841453B2

(12) United States Patent
Gold et al.

(10) Patent No.: US 7,841,453 B2
(45) Date of Patent: Nov. 30, 2010

(54) LUGGAGE CONSTRAINING APPARATUS AND SYSTEM

(75) Inventors: Nancy Gold, Niskayuna, NY (US); Christian Timm, Schenectady, NY (US); Inna Spektor, Niskayuna, NY (US)

(73) Assignee: Tough Traveler Ltd., Schenectady, NY (US)

( * ) Notice: Subject to any disclaimer, the term of this patent is extended or adjusted under 35 U.S.C. 154(b) by 1049 days.

(21) Appl. No.: 11/560,446

(22) Filed: Nov. 16, 2006

(65) Prior Publication Data

US 2008/0116028 A1 May 22, 2008

(51) Int. Cl.
*A45C 13/10* (2006.01)
*A45C 13/26* (2006.01)
*A45C 13/30* (2006.01)

(52) U.S. Cl. ..... 190/102; 190/39; 190/108; 190/115; 224/572

(58) Field of Classification Search ..... 190/15.1, 190/26, 102, 108, 18 A, 39, 115; 24/264, 24/300; 383/37; 224/572
See application file for complete search history.

(56) References Cited

U.S. PATENT DOCUMENTS 1,084,360 A * 1/1914 Rahm ..... 190/108
2,287,581 A * 6/1942 Walker ..... 248/694
2,707,035 A * 4/1955 Lashley ..... 224/616
4,759,431 A 7/1988 King et al.
5,026,089 A 6/1991 Grimmonpre
5,354,131 A * 10/1994 Mogil ..... 383/24
5,437,401 A * 8/1995 Seltzer ..... 224/578
5,547,052 A * 8/1996 Latshaw ..... 190/108
5,671,832 A 9/1997 London et al.
5,699,886 A * 12/1997 Latshaw ..... 190/108
5,762,169 A * 6/1998 Deliman et al. ..... 190/101
5,829,559 A 11/1998 Nordstrom et al.
5,842,673 A 12/1998 Fenton
5,890,571 A * 4/1999 Sadow ..... 190/102
5,927,450 A 7/1999 Sadow
6,141,841 A 11/2000 Workman
6,216,322 B1 4/2001 Kuo
6,374,467 B1 4/2002 Chen
6,631,538 B1 10/2003 Carr
6,640,400 B1 11/2003 Chen
6,772,485 B2 8/2004 Alpert
2002/0144376 A1* 10/2002 Lee ..... 16/114.1

(Continued)

FOREIGN PATENT DOCUMENTS

WO WO 99/34703 * 7/1999

*Primary Examiner*—Sue A Weaver
(74) *Attorney, Agent, or Firm*—Hoffman Warnick LLC; Stephen F. Swinton, Jr.

(57) ABSTRACT

The invention provides an apparatus for constraining an object against an article of luggage and related luggage systems. In one embodiment, the invention includes an elongate member; a first loop member located at a first end of the elongate member; and a second loop member located at a second end of the elongate member, wherein the first loop member is adapted for non-fixed attachment to a rigid, elongated handle of an article of luggage and the second loop member is adapted for non-fixed attachment to a handle of the article of luggage, such that when the first loop member is attached to the rigid, elongated handle and the second loop member is attached to the handle, the elongate member is operable to constrain an object against the article of luggage and the rigid, elongated handle.

3 Claims, 6 Drawing Sheets

U.S. PATENT DOCUMENTS

2003/0217443 A1* 11/2003 Chou ..... 24/300
2005/0232517 A1* 10/2005 Reid ..... 383/2
2006/0022006 A1* 2/2006 Cruise ..... 224/572
2006/0102672 A1 5/2006 Godshaw

* cited by examiner

LUGGAGE CONSTRAINING APPARATUS AND SYSTEM

BACKGROUND OF THE INVENTION

1. Technical Field

The invention relates generally to luggage devices, and more particularly, to an apparatus for constraining an object against an article of luggage and related luggage systems.

2. Background Art

Luggage straps and similar devices have been developed to enable a traveler to attach several articles of luggage together. Devices for attaching non-rolling articles of luggage to rolling articles of luggage are a particular example. For example, U.S. Patent Application Publication No. 20060102672 to Godshaw describes a strap for attaching one or more non-rolling articles of luggage by their handles to a handle of a rolling article of luggage. U.S. Pat. Nos. 5,842,673 to Fenton and 5,671,832 to London et al. describe similar devices. A major disadvantage with such devices, however, relates to their tendency to permit an attached article of luggage to move laterally with respect to the article of luggage to which it is attached. If the attached article of luggage is of substantial weight, this may cause both articles of luggage to tip or roll sideways. Even where the rolling article of luggage itself is not tipped or rolled sideways, lateral movement of the attached article of luggage is likely to interfere with a traveler's ability to roll the rolling article of luggage.

More elaborate devices have been developed to more securely transport articles of luggage. U.S. Pat. No. 5,026,089 to Grimmonpre, for example, describes a strap for use with a collapsible luggage carrier. However, such devices require a traveler to carry an additional article of luggage (i.e., the luggage carrier).

U.S. Pat. No. 5,927,450 to Sadow describes an auxiliary luggage holder integrated into a rolling article of luggage. However, the Sadow device is quite intricate and must be built into the article of luggage at the time of manufacture. Thus, the Sadow device cannot be used with other articles of luggage a traveler may wish to carry.

Accordingly, there is a need for an apparatus and system that does not suffer from the deficiencies known in the art.

SUMMARY OF THE INVENTION

The invention provides an apparatus for constraining an object against an article of luggage and related luggage systems.

A first aspect of the invention provides an apparatus for constraining an object against an article of luggage comprising: an elongate member; a first loop member located at a first end of the elongate member; and a second loop member located at a second end of the elongate member, wherein the first loop member is adapted for attachment to a rigid, elongated handle of an article of luggage and the second loop member is adapted for non-fixed attachment to a handle of the article of luggage, such that when the first loop member is attached to the rigid, elongated handle and the second loop member is attached to the handle, the elongate member is operable to constrain an object against the article of luggage and the rigid, elongated handle.

A second aspect of the invention provides an apparatus for constraining an object against an article of luggage comprising: an elongate member having a first and second end; a loop member located at the first end of the elongate member; and a connection device located at the second end of the elongate member, wherein the loop member is adapted for attachment to a rigid, elongated handle of an article of luggage and the connection device is adapted for non-fixed attachment to a complementary connection device on the article of luggage, such that when the loop member is attached to the rigid, elongated handle and the connection device is attached to the complementary connection device, the elongate member is operable to constrain an object against the article of luggage and the rigid, elongated handle.

A third aspect of the invention provides a luggage system comprising: an article of luggage including: a storage body; a rigid, elongated handle; and a complementary connection device; an apparatus for constraining an object against the article of luggage including: an elongate member having a first and second end; a loop member located at the first end of the elongate member; and a connection device located at the second end of the elongate member, wherein the loop member is adapted for attachment to the rigid, elongated handle and the connection device is adapted for non-fixed attachment to the complementary connection device, such that when the loop member is attached to the rigid, elongated handle and the connection device is attached to the complementary connection device, the elongate member is operable to constrain an object against the article of luggage and the rigid, elongated handle.

A fourth aspect of the invention provides a luggage system comprising: an article of luggage including: a storage body having a storage chamber; and a rigid, elongated handle; an apparatus for constraining an object against the article of luggage including: an elongate member having a first and second end; and a loop member located at the first end of the elongate member, wherein the loop member is adapted for non-fixed attachment to the rigid, elongated handle and the second end of the elongate member is fixedly attached to an inner surface of the storage chamber, such that when the loop member is attached to the rigid, elongated handle, the elongate member is operable to constrain an object against the article of luggage and the rigid, elongated handle The illustrative aspects of the present invention are designed to solve the problems herein described and other problems not discussed, which are discoverable by a skilled artisan.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION

As indicated above, the invention provides an apparatus for constraining an object against an article of luggage and related luggage systems.

Figure 1:
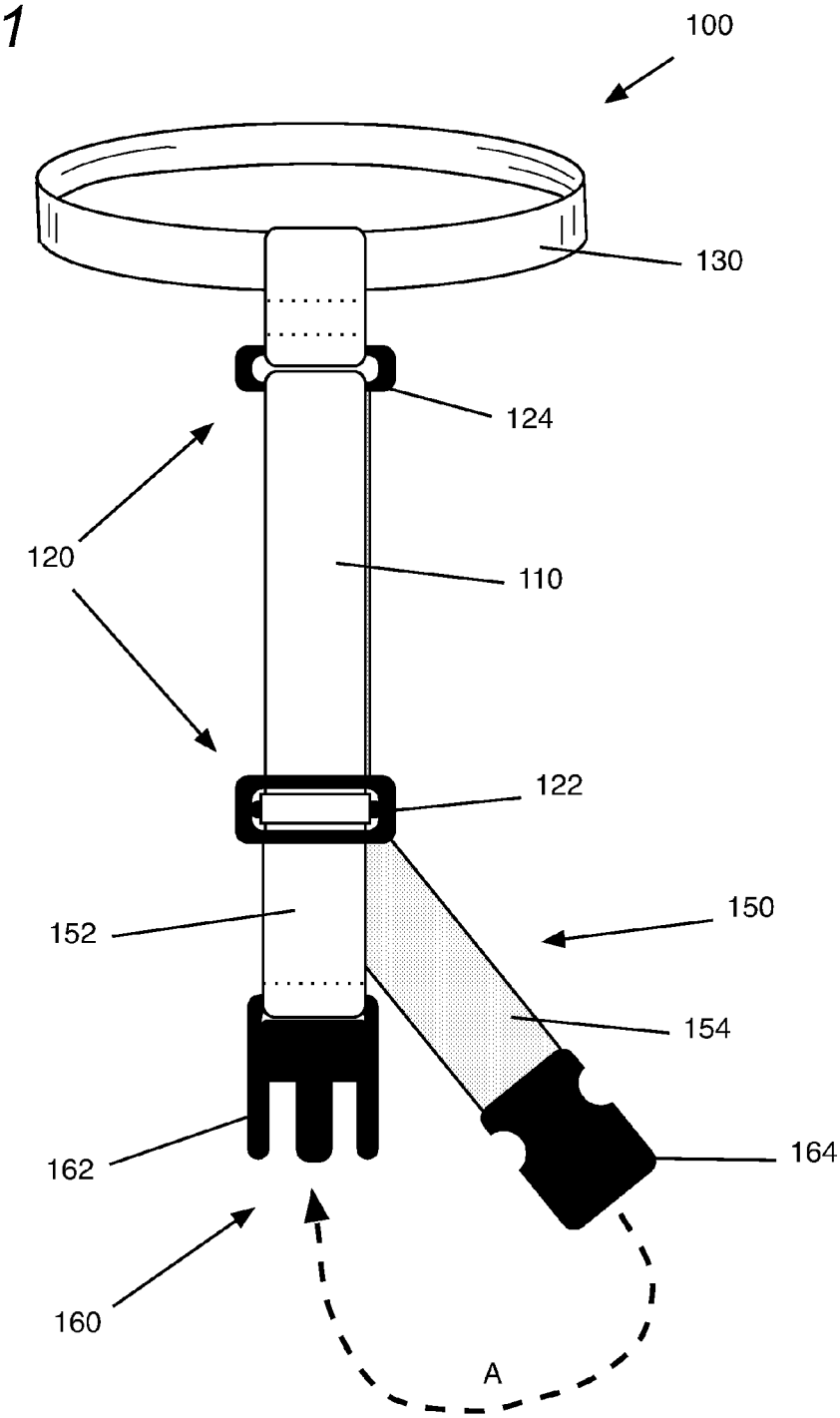
FIG. 1 shows an apparatus according to an embodiment of the invention.

Turning now to the drawings, FIG. 1 shows an illustrative embodiment of an apparatus 100 according to the invention. As shown, apparatus 100 comprises an elongate member 110, a first loop member 130 and a second loop member 150. As can be seen, second loop member 150 is discontinuous, having a first portion 152 and a second portion 154. First and second portions 152, 154 are non-fixedly joinable using connection device 160 having a male portion 162 on first portion 152 and a female portion 164 on second portion 154. Other types of connection devices may also be used, as will be recognized by one skilled in the art, and are within the scope of the invention. As will be explained in greater detail below, second loop member 150 may be attached to a handle of an article of luggage by connecting male portion 162 to female portion 164 after passing one or both under the handle along path A. In order to accommodate such attachment, the length of elongate member 110 may be adjusted using an adjustment device 120 comprising, for example, a tri-glide 122 and a retainer 124. Other devices for adjusting the length of elongate member 100 will be known to one skilled in the art and are within the scope of the invention.

Figure 2:
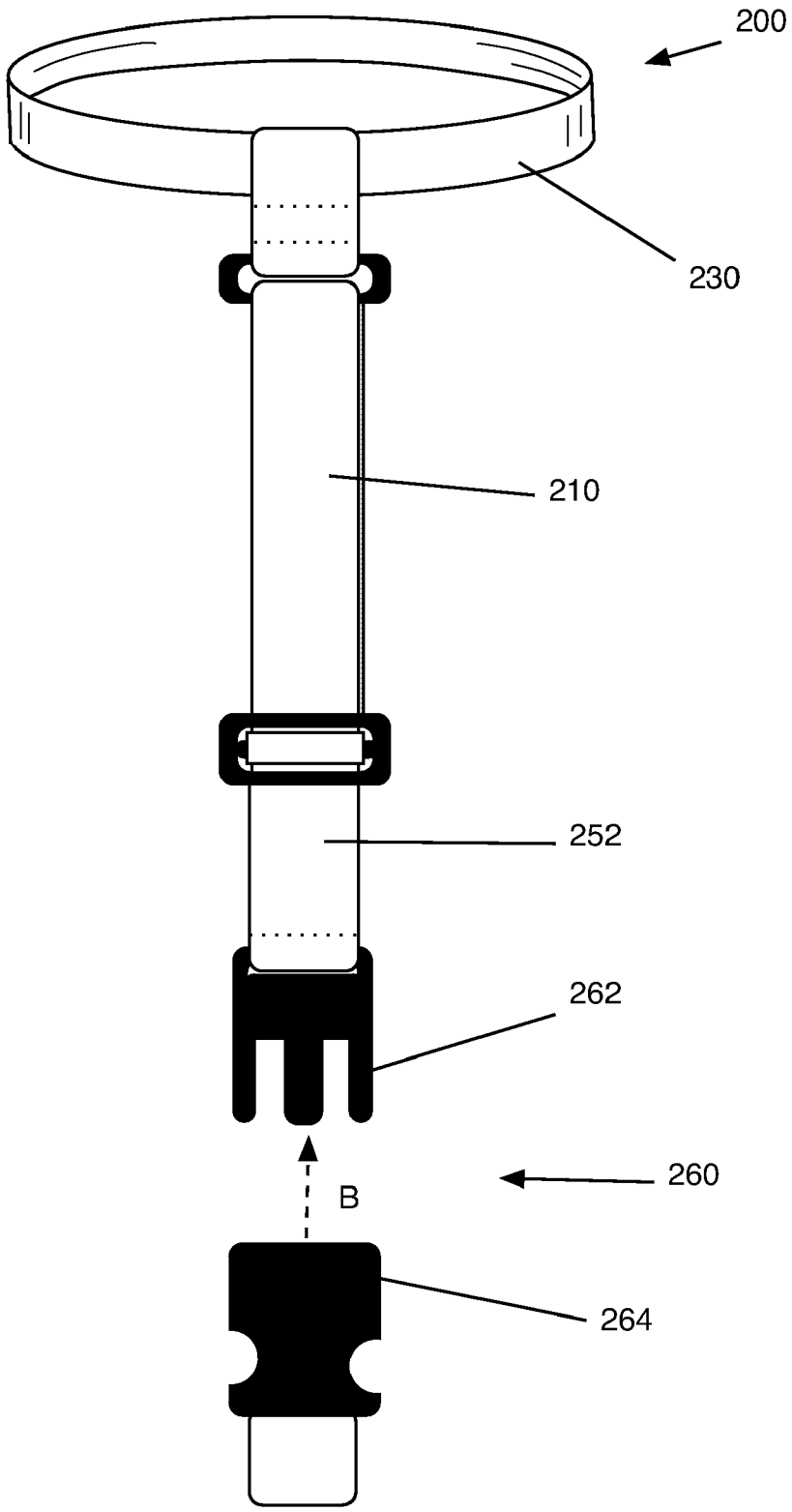
FIG. 2 shows an apparatus according to an alternative embodiment of the invention.

FIG. 2 shows an alternative embodiment according to the invention, wherein apparatus 200 includes only male portion 262 of connection device 260, with female portion 264 being fixedly or non-fixedly attached to an article of luggage, as will be shown in greater detail below.

Figure 3:
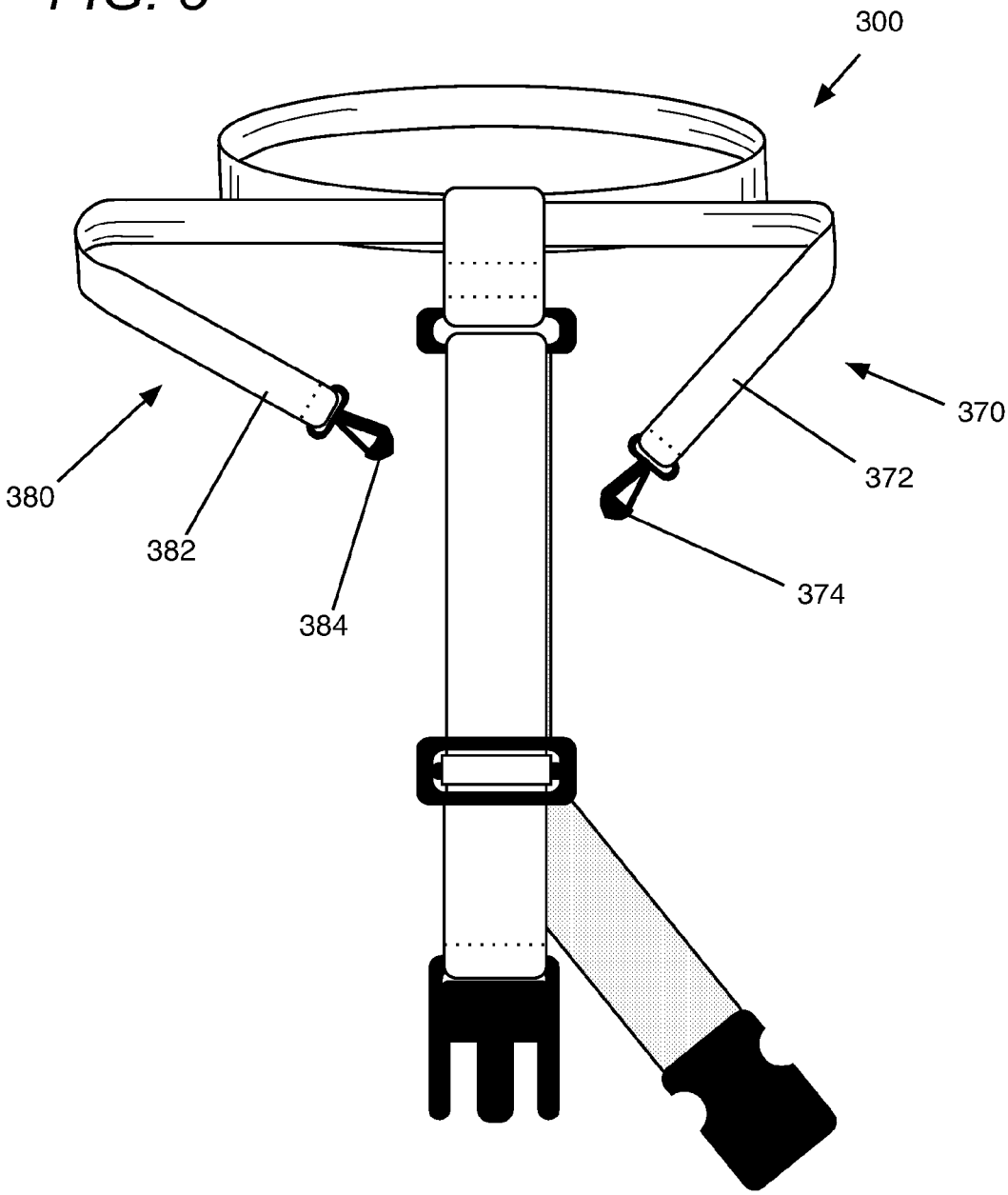
FIG. 3 shows an apparatus according to another alternative embodiment of the invention.

FIG. 3 shows yet another alternative embodiment according to the invention, wherein apparatus 300 further includes a pair of lateral members 370, 380 extending from an area adjacent first loop member 330. Each lateral member 370, 380 includes an elongated band 372, 382 and an attachment device 374, 384. As shown, attachment devices 374, 384 comprise a clip device, although other devices may also be used. As will be shown below, lateral members 370, 380 may be used to further constrain an object against an article of luggage to which device 300 is attached.

Figure 4A:
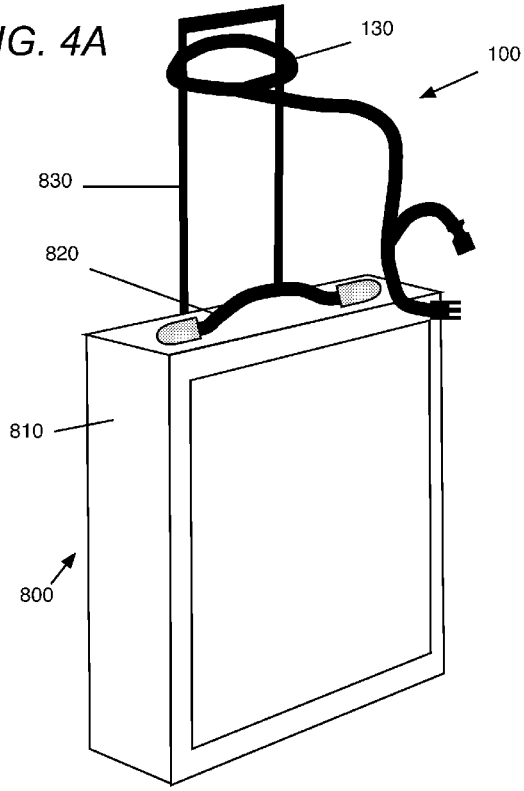
FIGS. 4A-E show various illustrative luggage systems according to the invention.
Figure 4B:
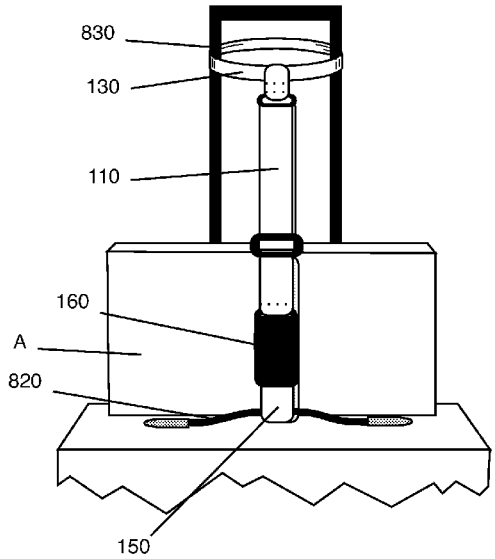

FIGS. 4A-B show an embodiment of an apparatus 100 according to the invention as attached to an article of luggage. In FIG. 4A, first loop member 130 of apparatus 100 has been attached to a rigid, elongated handle 830 of the article of luggage 800. First loop member 130 is therefore preferably a continuous loop of elastic material, such that it may be securely attached to handles of varying sizes without need for adjustment. First loop member 130 may be fixedly or non-fixedly attached to elongated handle 830.

In FIG. 4B, an object A (e.g., another article of luggage, a container, an article of clothing, or any other object a user may wish to carry with article of luggage 800) has been placed atop the storage body 810 and in front of rigid, elongated handle 830 of article of luggage 800. Second loop member 150 has been made continuous by passing second portion 154 (FIG. 1) under handle 820 and joining male portion 162 (FIG. 1) and female portion 164 (FIG. 1) of connection device 160, thereby constraining object A between elongate member 110 and rigid, elongated handle 830. In some embodiments of the invention, elongate member 110 may be elastic.

Figure 4C:
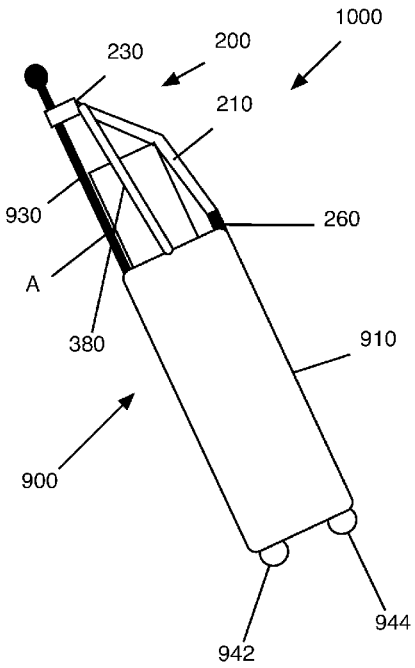

FIG. 4C shows a side view of a similar luggage system 1000, wherein a portion of connection device 260 (either a male portion or a female portion, see FIG. 1) is fixedly or non-fixedly attached to storage body 910 of article of luggage 900, such that no portion of apparatus 200 need be passed under a handle of article of luggage 900 in order to constrain object A between elongate member 210 and rigid, elongated handle 930. As shown, storage body 910 includes wheels 942, 944 for rolling luggage system 1000.

Figure 4D:
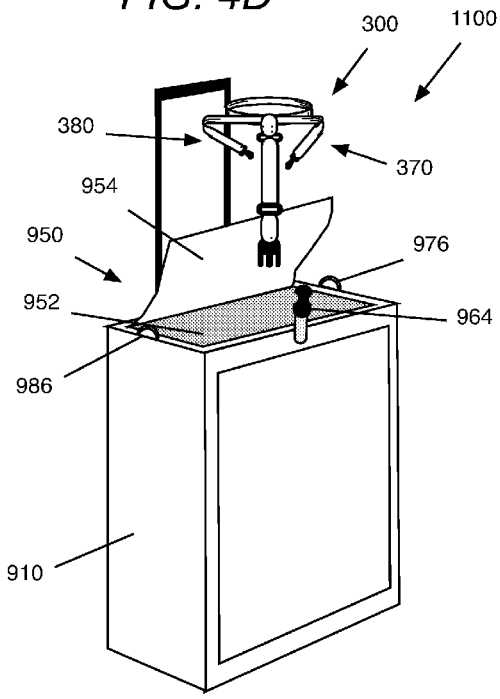

FIG. 4D shows an alternative luggage system 1100 according to the invention, wherein storage body 910 includes a compartment 950 having a chamber 952 and cover 954 for storing apparatus 300 when not in use. Cover 954 may be closed to seal chamber 952 using any known or later-developed mechanism, such as zippers, hooks and loops, snaps, etc.

As shown, storage body 910 includes rings 976, 986 to which clips 374, 384 of lateral members 370, 380 may be attached, thereby constraining an object (e.g., object A in FIG. 4C) against not only elongate member 310 and rigid, elongated handle 930, but also lateral members 370, 380.

Figure 4E:
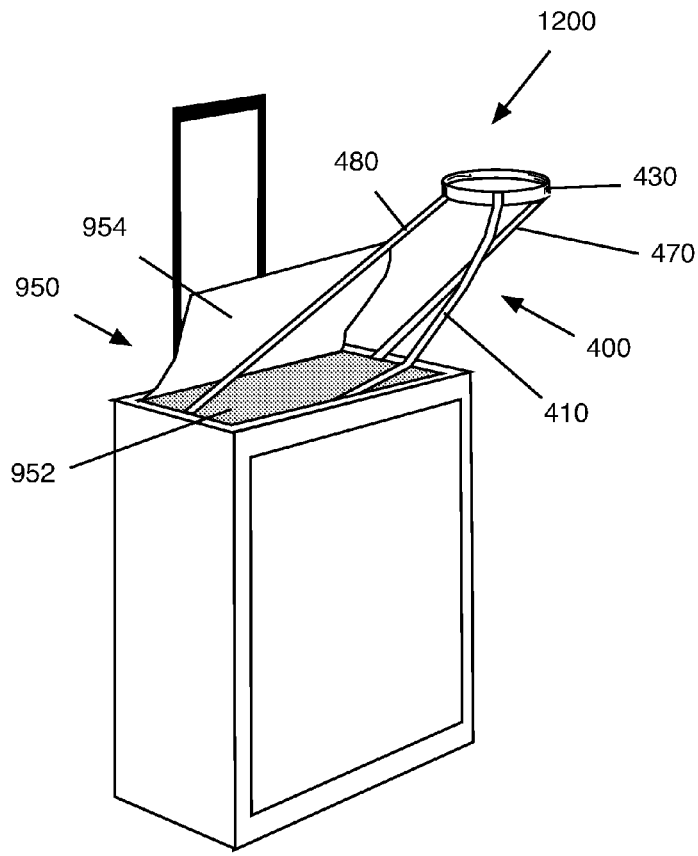

FIG. 4E shows another alternative luggage system 1200 according to the invention, wherein apparatus 400 is fixedly attached (by, e.g., stitching, rivets, etc.) to an inner surface of chamber 952. Specifically, distal ends (i.e., ends opposite loop member 430) of elongate member 410 and lateral members 470, 480 are fixedly attached to an inner surface of chamber 952, such that apparatus 400 may be stored within chamber 452 when not in use. When in use, apparatus 400 is removed from chamber 452 and loop member 430 attached to elongated handle 930, as shown in FIG. 4C. In an alternative embodiment, apparatus does not include lateral members 470, 480.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. An apparatus for constraining an object against an article of luggage comprising:

an elongate member;

a continuous elastic band fixedly attached to a first end of the elongate member; and a discontinuous member fixedly attached to a second end of the elongate member, the discontinuous member having a first portion, a second portion, and a connection device for non-fixedly joining the first and second portions, wherein the continuous elastic band is dimensioned for passage around a double-pole, rigid, elongated handle of an article of luggage and the discontinuous member is adapted for non-fixed attachment to a handle of the article of luggage, such that when the continuous elastic band is passed around the double-pole, rigid, elongated handle and the discontinuous member is attached to the handle, the elongate member is operable to constrain an object against the article of luggage and the double-pole, rigid, elongated handle.

2. The apparatus of claim 1, wherein the elongate member is elastic.

3. The apparatus of claim 1, wherein a length of the elongate member is adjustable.

* * * * *